US007857011B2

(12) United States Patent
Adriaen

(10) Patent No.: US 7,857,011 B2
(45) Date of Patent: Dec. 28, 2010

(54) DRIVE FOR A WEB MACHINE

(75) Inventor: Marc Adriaen, Hollebeke (BE)

(73) Assignee: Picanol N.V., Ypres (BE)

( * ) Notice: Subject to any disclaimer, the term of this patent is extended or adjusted under 35 U.S.C. 154(b) by 221 days.

(21) Appl. No.: 11/631,520

(22) PCT Filed: Jul. 2, 2005

(86) PCT No.: PCT/EP2005/007166

§ 371 (c)(1),
(2), (4) Date: Sep. 11, 2008

(87) PCT Pub. No.: WO2006/002962

PCT Pub. Date: Jan. 12, 2006

(65) Prior Publication Data

US 2009/0038705 A1 Feb. 12, 2009

(30) Foreign Application Priority Data

Jul. 5, 2004 (BE) ..... 2004/0330

(51) Int. Cl.
*D03D 51/02* (2006.01)
*D03D 51/00* (2006.01)

(52) U.S. Cl. ..... 139/1 E; 139/55.1; 139/99

(58) Field of Classification Search ..... None
See application file for complete search history.

(56) References Cited

U.S. PATENT DOCUMENTS 3,875,972 A * 4/1975 Duprey ..... 139/1 E
4,448,220 A * 5/1984 Zwiener et al. ..... 139/1 E
4,474,219 A * 10/1984 Froment ..... 139/1 E
4,478,254 A * 10/1984 Beaudoux et al. ..... 139/1 E
4,537,226 A * 8/1985 Gotoh ..... 139/100
5,404,916 A * 4/1995 Mueller et al. ..... 139/116.2
5,617,901 A * 4/1997 Adriaen et al. ..... 139/1 E (Continued)

FOREIGN PATENT DOCUMENTS

EP 0 726 345 A1 8/1996

(Continued)

OTHER PUBLICATIONS

Dictionary.com, "gear," in The American Heritage® Dictionary of the English Language, Fourth Edition. Source location: Houghton Mifflin Company, 2004. http://dictionary.reference.com/browse/gear. Available: http://dictionary.reference.com. Accessed: May 14, 2010.*

*Primary Examiner*—Bobby H Muromoto, Jr.
(74) *Attorney, Agent, or Firm*—Bacon & Thomas, PLLC

(57) ABSTRACT

A drive system for a weaving loom includes a switching wheel (5) which can be driven by of a main drive motor (7) and can be axially displaced between at least two switching positions, which, in a first switching position, is in drive connection with two groups of elements to be driven (9, 10, 11; 12, 13, 14) and, in a second switching position, is disengaged from one of the groups of elements to be driven (12, 13, 14). A device (15) is provided which becomes active as the drive connection with one group is disengaged and which has a tooth element (22) which engages with a gear wheel (12) of the group of elements to be driven (12, 13, 14) and disengaged from the switching wheel (5).

18 Claims, 10 Drawing Sheets

U.S. PATENT DOCUMENTS

| | | | | |
|---|---|---|---|---|
| 5,669,423 | A * | 9/1997 | Adriaen | 139/449 |
| 6,247,503 | B1 * | 6/2001 | Shaw et al. | 139/1 E |
| 6,307,340 | B1 * | 10/2001 | Wagner et al. | 318/431 |
| 6,525,496 | B1 * | 2/2003 | Bilcke | 318/432 |
| 6,707,267 | B2 * | 3/2004 | Bilcke | 318/432 |
| 6,962,171 | B2 * | 11/2005 | Krumm et al. | 139/116.2 |
| 7,227,319 | B2 * | 6/2007 | Adriaen et al. | 318/3 |
| 7,341,077 | B2 * | 3/2008 | Sampers | 139/55.1 |

FOREIGN PATENT DOCUMENTS

| | | | |
|---|---|---|---|
| EP | 0 930 387 | A1 | 7/1999 |
| EP | 1 158 081 | A1 | 11/2001 |
| EP | 0 953 073 | B1 | 10/2002 |
| FR | 2 755 155 | | 4/1998 |

* cited by examiner

DRIVE FOR A WEB MACHINE

The invention relates to a drive system for a weaving loom comprising a switching wheel which can be driven by means of a main drive motor and can be axially displaced between at least two switching positions, which, in a first switching position, is in drive connection with two groups of elements to be driven and, in a second switching position, is disengaged from one of the groups of elements to be driven, and comprising a device which becomes active as the drive connection with one group is disengaged and which holds the group of elements to be driven which is disengaged from the switching wheel in a defined position.

A drive system of the type mentioned in the introduction is known from EP 0 726 345 A1. It comprises a main drive shaft mounted in the machine frame that is driven by means of a drive motor via transmission elements, for example via a belt drive system. The main drive shaft has an axially shiftable switching wheel that in a first position is engaged with both a first gear wheel for at least the drive system of a weaving sley, and with a second gear wheel for at least the drive system of the shed forming means. In the second switching position it is engaged with only one of the two gear wheels. The switching wheel and the main drive shaft are connected together in a rotationally fixed manner by means of a gearing so that the axially displaceable switching wheel is connected backlash-free to the main drive shaft. A backlash-free connection in the rotation direction is necessary in order to be able to vary the drive moment to be transmitted in a positive and in a negative direction. A switchable clutch and/or a switchable brake can be arranged in the connection between the main drive motor and the main drive shaft. If the drive system is used for gripper looms, the first gear wheel can also drive a drive system for the gripper in addition to the weaving sley. During normal weaving and during slow weaving, the switching wheel is engaged with both gear wheels. During so-called pick finding (finding a broken weft thread), the switching wheel is only engaged with the gear wheel which drives the shed forming means. During slow operation and during pick finding, the drive motor is driven at a lower speed than during normal weaving. As an alternative, the drive for slow operation and for pick finding can also be by means of a separate slow-running motor. When the drive connection to one of the groups is disengaged, a device is activated which engages with a recess in the gear wheel by means of a mandrel, which gear wheel is disengaged from the switching wheel and which forms part of the group of elements, the drive connection of which is disengaged. The drive connection can thus only be disengaged when the mandrel and the recess of this drive gear wheel are located opposite one another.

The object of the invention is to improve a drive system of the type mentioned in the introduction, more particularly during pick finding.

This object is achieved by the fact that the device has a tooth element which can engage with a gear wheel of the group of elements to be driven which group is disengaged from the switching wheel.

The embodiment of the drive system according to the invention offers the advantage that the drive connection between the switching wheel and a group of the elements to be driven can be interrupted in a large number of positions, with this number of positions being determined among other things by the number of teeth of the above-mentioned gear wheel with which the tooth element engages. This also enables the drive connection to be interrupted in practically any position of the switching wheel. Furthermore such a drive system is compact and requires little installation space.

In one embodiment of the invention, it is provided that the tooth element of the device is assigned to a drive gear wheel which engages with the switching wheel in the first switching position of the switching wheel. The group of elements to be driven by this drive gear wheel can be held in a large number of positions.

According to a preferred embodiment, in the second switching position of the switching wheel the tooth element of the device is engaged with the teeth of the drive wheel of the group of elements to be driven that in the first position of the switching wheel is engaged with the switching wheel and in the second switching position is disengaged. This allows the device with the tooth element to be installed near the switching wheel. The number of positions in which the drive connection can be disengaged is determined by the number of teeth of the drive wheel. This embodiment permits an especially compact design. Furthermore this embodiment offers the advantage that the drive wheel that can engage with the switching wheel is held directly; this is advantageous for re-engagement of the drive wheel with the switching wheel.

According to one embodiment the device has at least one toothed segment which is assigned to the teeth of a gear wheel of a group of the elements to be driven. This allows the relevant gear wheel to be blocked and held in certain angular positions. The teeth of the toothed segment are expediently chosen in such a way in relation to the teeth of the gear wheel that a correct engagement of the teeth is obtained.

According to one embodiment, the device has a tooth element in the form of a gear wheel. If this gear wheel is installed so that it cannot rotate, it allows the respective group of elements to be driven to be held in predetermined angular positions.

According to a variant embodiment, the gear wheel is connected to an auxiliary drive system to which a control unit is assigned by means of which the group of elements to be driven which group is disengaged from the switching wheel can be brought into a position adapted to the position of the other group before the drive connection with the switching wheel is re-established. The drive connection can then be re-established without the group whose drive connection with the switching wheel was not interrupted, changing its position.

According to one embodiment the drive system has a shifting device to shift at least the tooth element according to the invention, and preferably the switching wheel together with the tooth element, in an axial direction of the switching wheel between the first switching position and the second switching position. This makes a compact design of the drive system according to the invention possible. It also helps to ensure that the tooth element is engaged with the respective gear wheel when the drive connection between this gear wheel and the switching wheel is disengaged.

In one embodiment, it is provided that a drive wheel which is driven by the main drive motor is assigned to the switching wheel, which drive wheel is engaged with the switching wheel both in the first switching position and in the second switching position. In a variant embodiment, it is provided that the switching wheel is directly connected to the motor shaft of the main drive motor.

Further features and advantages of the invention can be seen from the following description of the illustrative embodiments shown in the drawings.

Figure 1:
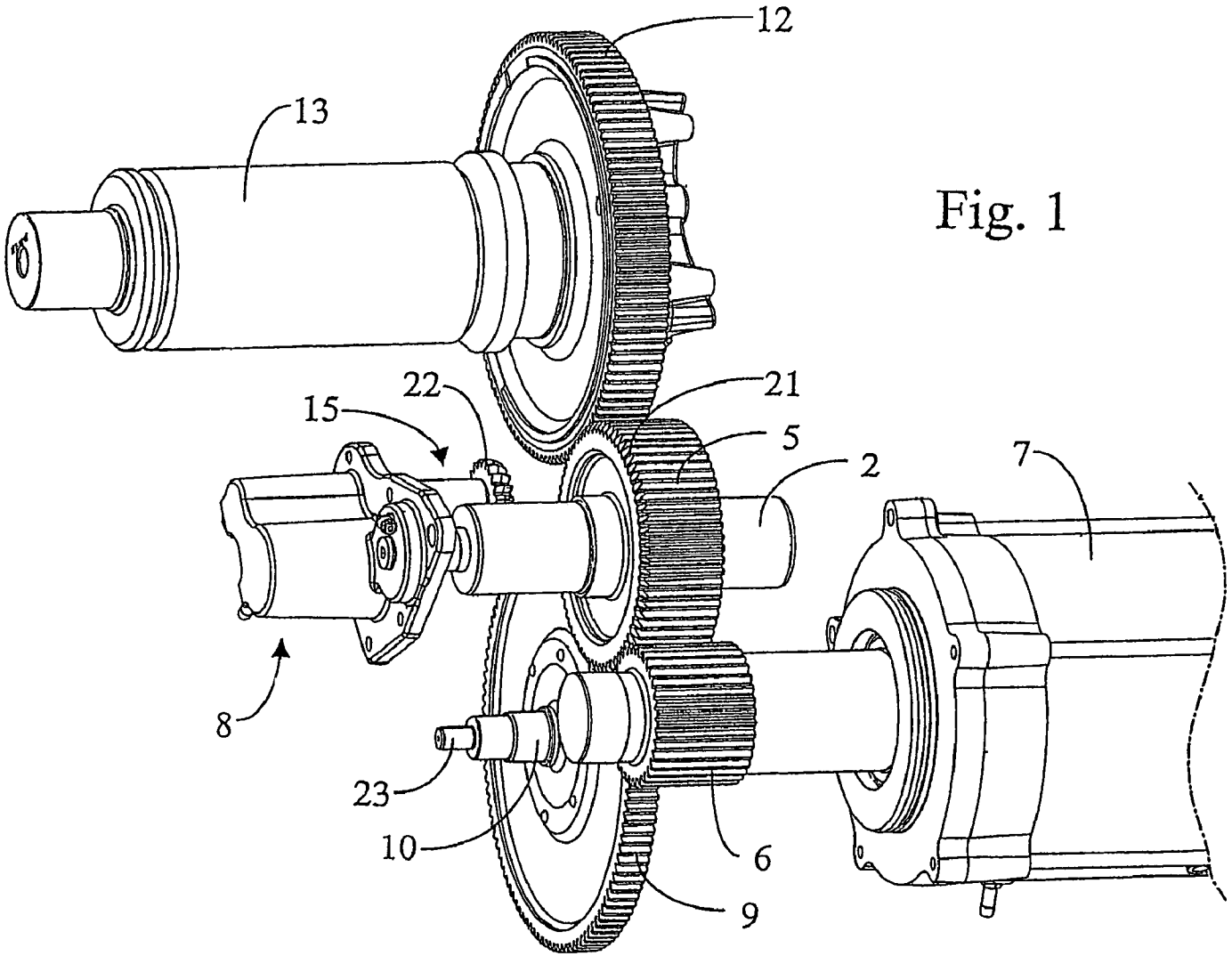
FIG. 1 shows a simplified perspective view of a drive system according to the invention for a weaving loom in a first switching position of the switching wheel.

According to the drive system for a weaving loom shown in FIGS. 1 to 5, a main drive shaft 2 is mounted in a machine frame 1 by means of roller bearings 3, 4. Mounted on the main drive shaft 2 is a switching wheel 5 that is driven by means of a drive wheel 6 and by means of an electric motor serving as the main drive motor 7. The switching wheel 5 can be manufactured in one piece with the main drive shaft or can be mounted on the latter.

The switching wheel 5 is engaged with a drive wheel 9 that has an axial gearing and that is connected to one or more driven elements 11 by means of a shaft 10. The driven elements 11 are, for example, shed drive elements that consist of a dobby, a cam motion, a jacquard machine or some other device for the forming of weaving sheds. The driven elements 11 can also be other devices, for example selvedge forming devices or a device for the positive driving of a backrest beam.

In the switching position shown in FIG. 1, the switching wheel 5 is also engaged with a drive wheel 12 that has an axial gearing and that is connected to further driven elements 14 by means of a shaft 13. These driven elements 14 are, for example, the drive apparatus for a weaving sley and, in the case of a gripper loom, the drive apparatus for grippers or rapiers. The driven elements 14 can also be other devices, for example selvedge tuck-in devices, a device for driving the fabric winder or a device for driving the waste winder. In the illustrative embodiment shown, the main drive shaft 2 and the shafts 10 and 13 are arranged parallel to one another.

In order to limit the drive torque to be provided by the main drive shaft 2, the diameter of the switching wheel 5 is selected smaller than the diameter of the drive wheels 9 and 12 in the embodiment shown. For the same reason, the diameter of the drive wheel 6 is smaller than the diameter of the switching wheel 5. In the embodiment shown, the drive wheels 9 and 12 are arranged in such a manner that they rotate by one revolution per weft insertion.

In the first switching position of the switching wheel 5 that is shown in FIG. 1, the weaving loom is driven by means of the main drive shaft 2 during weaving. In this switching position, the switching wheel 5 is engaged with both drive wheels 9 and 12 so that these drive wheels 9 and 12 are driven by the main shaft 2 via the switching wheel 5. In this switching position, a drive connection exists, via the drive wheel 9, between the switching wheel 5 and a first group of elements to be driven 11 and, via the drive wheel 12, a drive connection exists with a second group of elements to be driven 14.

Figure 2:
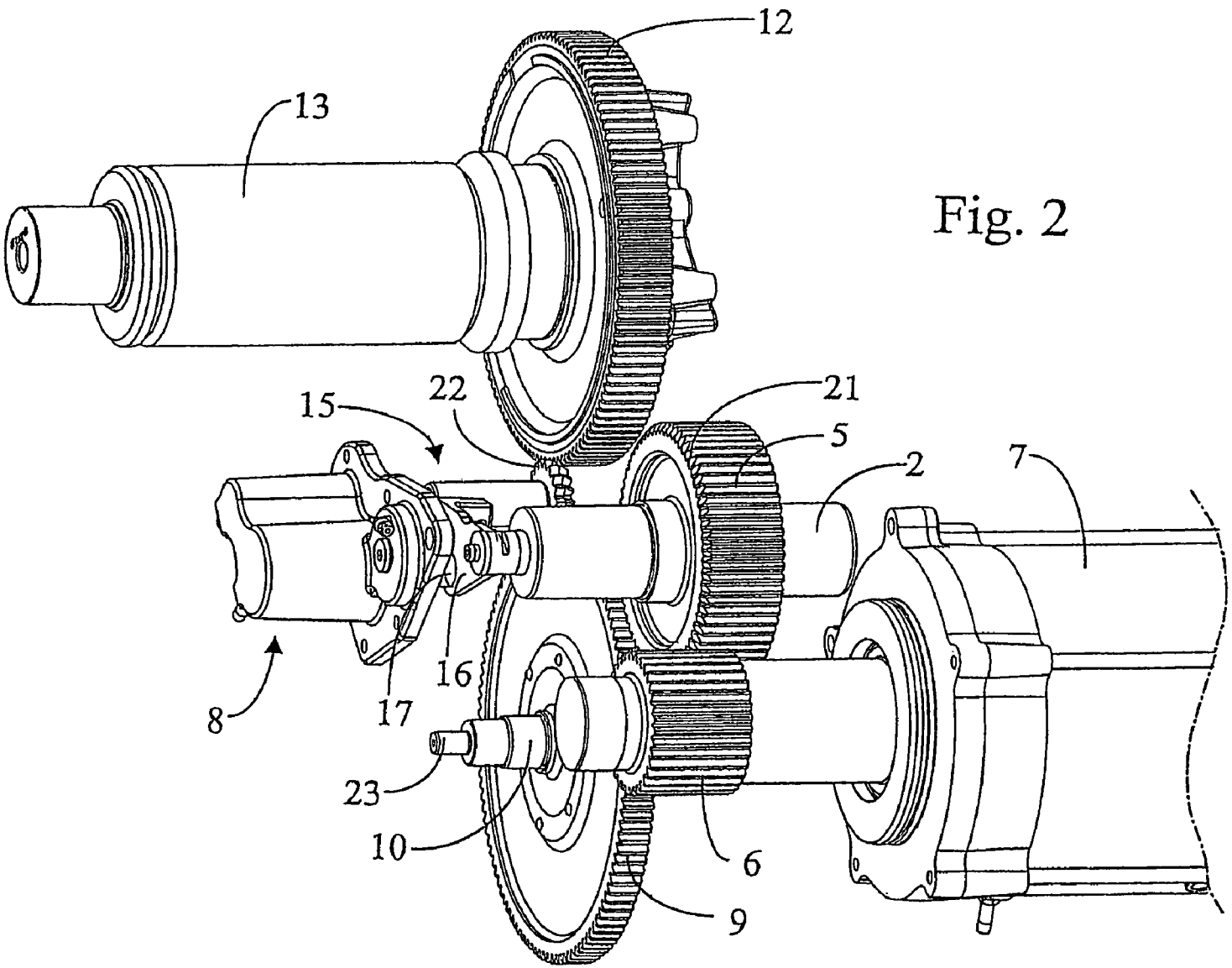
FIG. 2 shows the view according to FIG. 1 in a second switching position of the switching wheel.

If, after a stop of the weaving loom, the drive connection between the main drive shaft 2 and the elements to be driven 14, in particular the weaving sley, has to be interrupted in order to perform a so-called pick finding, the main drive shaft 2 with the switching wheel 5 is moved by axial shifting into the second switching position that is shown in FIG. 2. In this switching position, the switching wheel 5 remains engaged with the drive wheel 9 so that the drive connection with the elements to be driven 11 is maintained. However, the switching wheel 5 is disengaged from the drive wheel 12, so that the drive connection with the drive elements to be driven 14 is interrupted.

A shifting device 8 is provided for the axial shifting of the switching wheel 5. The shifting device 8 has a frame 16 that interacts with the main drive shaft 2. The frame 16 is driven by means of a plunger 17 which is arranged in a cylinder 18. The cylinder 18 is connected to a hydraulic or pneumatic circuit 19, for example to a hydraulic circuit that is similar to the hydraulic circuit according to EP 0 726 354 A1 or to that according to EP 0 953 073 A1. The frame 16 is hydraulically or pneumatically moved in the direction towards the main drive shaft 2. In order to move the frame 16 in the opposite direction, a return spring 20 is provided in the illustrative embodiment. According to a variant, the shifting device has a plunger/cylinder-unit for each direction of movement so that no return spring is required. The teeth of the toothing on the switching wheel 5 are preferably bevelled on the side flanks 21 facing the drive wheel 12 in order, on the one hand, to simplify the engagement of the switching wheel 5 with the drive wheel 12 and, on the other hand, to allow the drive wheel 12 to be turned slightly during engagement of the gear wheel 5, if desired. The drive system according to the invention also has a device 15 to hold the first group of elements to be driven 12, 13 and 14 in the second switching position, when the drive connection with the switching wheel 5 is disengaged, in a defined position. In the second position of the switching wheel 5, a gear wheel 22 of the device 15 engages with the teeth of the drive wheel 12 which belongs to this group of elements to be driven.

In the second switching position (FIG. 2), the drive wheel 6 remains in drive connection with the switching wheel 5 and the switching wheel 5 remains in drive connection with the drive wheel 9.

The device 15 has a gear wheel 22 that can engage with the teeth of the drive wheel 12 and that is attached to the above-mentioned frame 16. The gear wheel 22 is also shifted together with the switching wheel 5 between the first position and the second position in the axial direction by means of the shifting device 8 that acts on the frame 16. In one direction, the displacing drive is carried out by means of the plunger 17 and in the other direction by means of the return spring 20. In order to simplify the engagement of the teeth of the gear wheel 22 with the teeth of the drive wheel 12, the teeth of the gear wheel 22 and/or the areas facing the latter of the teeth of the drive wheel 12 are bevelled. The position of the gear wheel 22 on the frame 16 and thus the alignment in the axial direction relative to the switching wheel 5 is selected such that the teeth of the gear wheel 22 are already engaged with the teeth of the drive wheel 12 before the switching wheel 5 is completely disengaged from the drive wheel 12, in other words before the switching wheel 5 has reached the second switching position as shown in FIG. 2. This ensures that the drive wheel 12 is already held by the gear wheel 22 at the moment the switching wheel 5 and the drive wheel 12 are disengaged.

The main drive motor 7 is an electric motor which is preferably adjustable as far as its rotational speed and/or angular position and/or drive torque and/or direction of rotation is concerned. It is controlled by means of a control unit 24 which controls the starting and stopping of the weaving loom, the slow operation or the pick finding and the disengagement in a desired angular position and the re-engagement in a desired relative angular position of the switching wheel 5 and the drive wheel 12. A variable-speed reluctance motor is preferably used as main drive motor 7, offering the advantage that such a drive motor can be braked electrically in given positions. The main drive motor 7 can possibly also be equipped with an integral controllable brake that can be engaged when the main drive motor 7 has to be held in a given angular position. This type of brake is preferably brought into the braking condition, for example, by springs and released by electromagnetic forces. This enables the weaving loom to be held in a braked condition in the event of a failure of the power supply.

Figure 3:
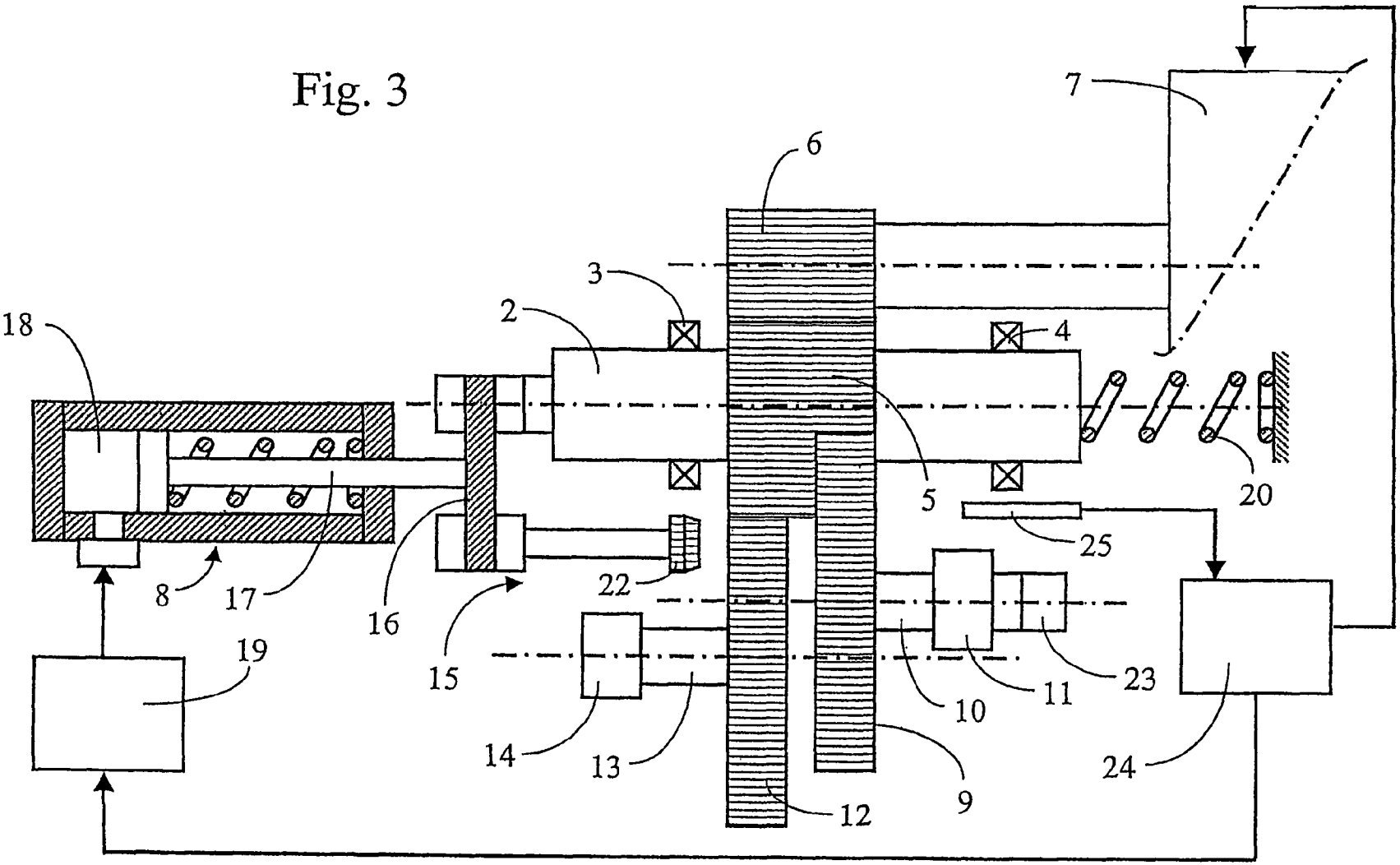
FIG. 3 shows a partially cut-away view of an embodiment corresponding in principle to that of FIG. 1 in the first switching position.
Figure 4:
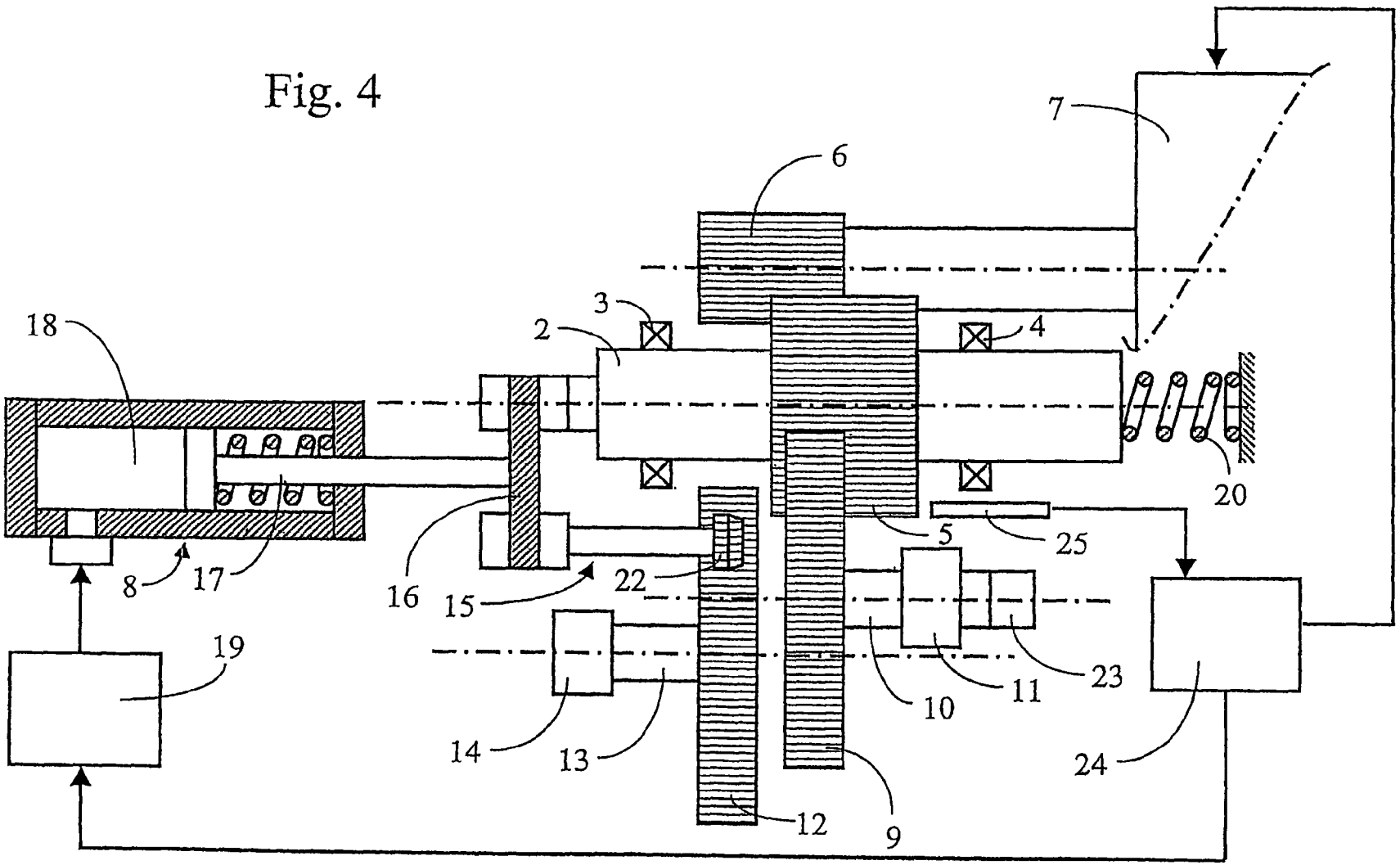
FIG. 4 shows a view corresponding to that of FIG. 3 in the second switching position.

As can be seen in FIGS. 3 and 4, the drive system has an angle transducer 23. In the embodiment shown, this angle transducer 23 is linked mechanically to the shaft 10 of the drive wheel 9. It is connected to the control unit 24. This angle transducer 23 allows the angular position of the drive wheel 9 and hence also the angular position of the main drive shaft 2 that is permanently connected with the main drive shaft 2 via the switching wheel 5 to be determined. The angular position of the main drive shaft 2 is important not only for the engagement and disengagement of the switching wheel 5 and the drive wheel 12, but also for the engagement and disengagement of the gear wheel 22 and the drive wheel 12.

The signals of the angle transducer 23 are brought into relationship with the angular position of the main drive shaft 2 by means of the control unit 24. For this the weaving loom is brought, for example, into the stop position. The angular position measured by the angle transducer 23 in this position is stored as the zero position of the main drive shaft 2 in the control unit 24. Any other measured angular position of the angle transducer 23 can then be converted into the angular position of the main drive shaft 2 by means of the control unit 24. The angular positions of the main drive shaft 2 or the angular positions of the drive wheel 9 are stored in the control unit 24 at which the teeth of the gear wheel 22 can be pushed into the teeth of the drive wheel 12, in other words when the teeth and the tooth gaps are opposite one another. Before axially shifting the gear wheel 22 together with the switching wheel 5, the main drive shaft 2 is brought into an angular position in which the teeth of the gear wheel 22 can be pushed between the teeth of the drive wheel 12. During the disengagement of the switching wheel 5 and the drive wheel 12, the teeth of the drive wheel 12 have to be positioned in such a way that the teeth of the gear wheel 22 can engage with the teeth of the drive wheel 12. If the drive wheel 12 has, in one example, 112 teeth, the gear wheel 22 can be pushed into the drive wheel 12 in 112 different angular positions of the drive wheel 12. Thus, pick finding is possible in 112 different positions. It is obvious that not all possible angular positions have to be used. Other limitations may for example prevent a pick finding in certain angular positions.

During the re-engagement of the switching wheel 5 and the drive wheel 12, the teeth of the drive wheel 12 also have to be positioned in such a way that the teeth of the switching wheel 5 can engage with them. For this, the switching wheel 5 can be brought to the required position by the drive motor 7 in which the teeth of the switching wheel 5 can be pushed into the teeth of the drive wheel 12. The determination of the angular positions of the main drive shaft 2 by means of the angle transducer 23 and the control unit 24 is also important as feedback for the controllable drive motor 7 for controlling of the angular position and/or the rotational speed and/or the drive torque of the drive motor 7.

A monitoring device can also be assigned to the drive wheel 12 to monitor whether engagement takes place in the desired angular position. The switching wheel 5 may, for example, be provided with a contactless limit switch 25 to monitor whether the gear wheel 22 is engaged with the drive wheel 12, when the gear wheel 22 is in the position shown in FIG. 2. According to the variant not illustrated, a contactless limit switch 25 can also be assigned to the gear wheel 22 or the frame 16. The signal from the contactless limit switch 25 that indicates that the gear wheel 22 is in the correct position can be used to enable the pick finding to start and/or to prevent the control unit 24 from starting the weaving loom at normal speed. If the gear wheel 22 or the switching wheel 5 is in the position shown in FIG. 1, the signal supplied by the limit switch 25 can then be used to allow the control unit 24 to start the weaving loom at normal speed.

During pick finding the shifting device 8 is controlled in such a way that the switching wheel 5 is pushed into the switching position according to FIG. 2 in which the switching wheel 5 is disengaged from the drive wheel 12 and thus at least from the drive of the weaving sley. The drive connection with the drive wheel 9 and thus with the drive of the shed forming device remains. The gear wheel 22 also engages with the drive wheel 12, so that the drive wheel 12 is held in a position determined by the gear wheel 22. The drive motor is then controlled by the control unit 24 in such a way that the pick finding is performed at a lower speed. In this case, the drive wheel 9 is driven until a weft thread is exposed by the shed forming device. The drive motor 7 is then controlled in such a way that the main drive shaft 2 returns to an angular position predetermined by the angle transducer 23, for example in the angular position that the main drive shaft 2 had before the pick finding. In this angular position, the switching wheel 5 is brought back into engagement with the drive wheel 12 and the gear wheel 22 is disengaged from the drive wheel 12 by the switching wheel 5 being returned axially by means of the shifting device 8 into the switching position shown in FIG. 1. Instead of the angular position in which the disengagement between switching wheel and drive wheel took place, a different angular position can be selected for the re-engagement of the control unit 24. The normal weaving process can then be started again.

Figure 6:
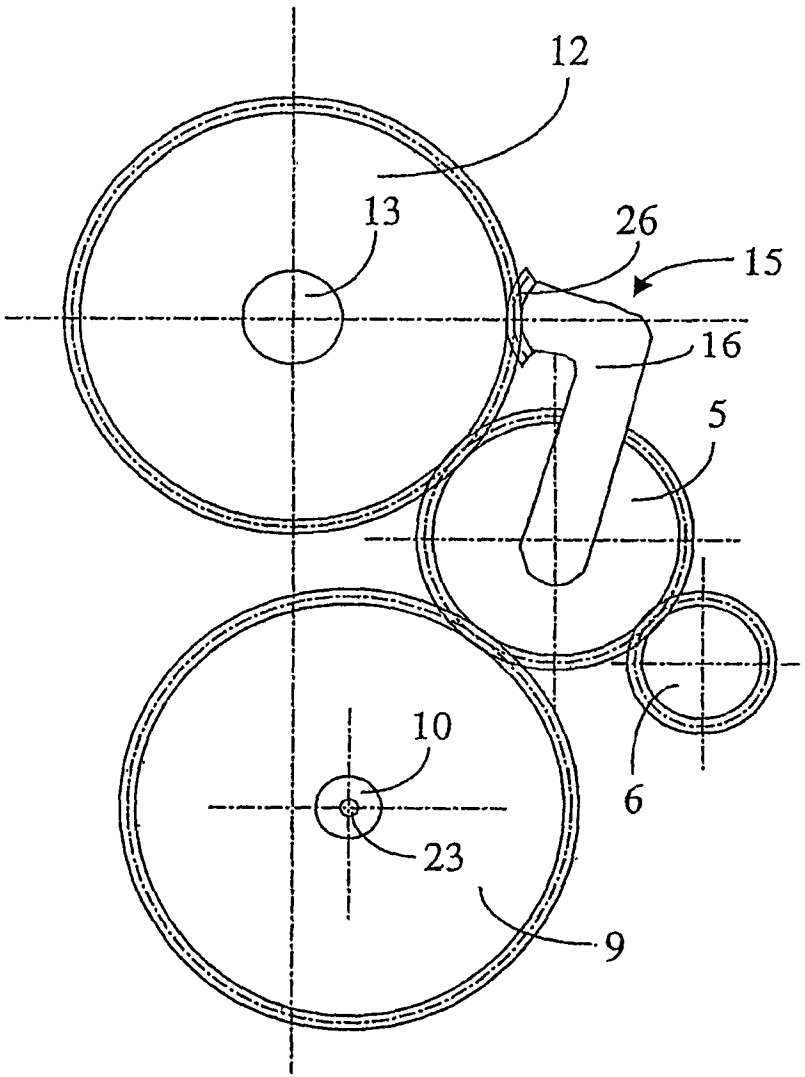
FIG. 6 shows a view of a variant embodiment similar to that of FIG. 5.
Figure 5:
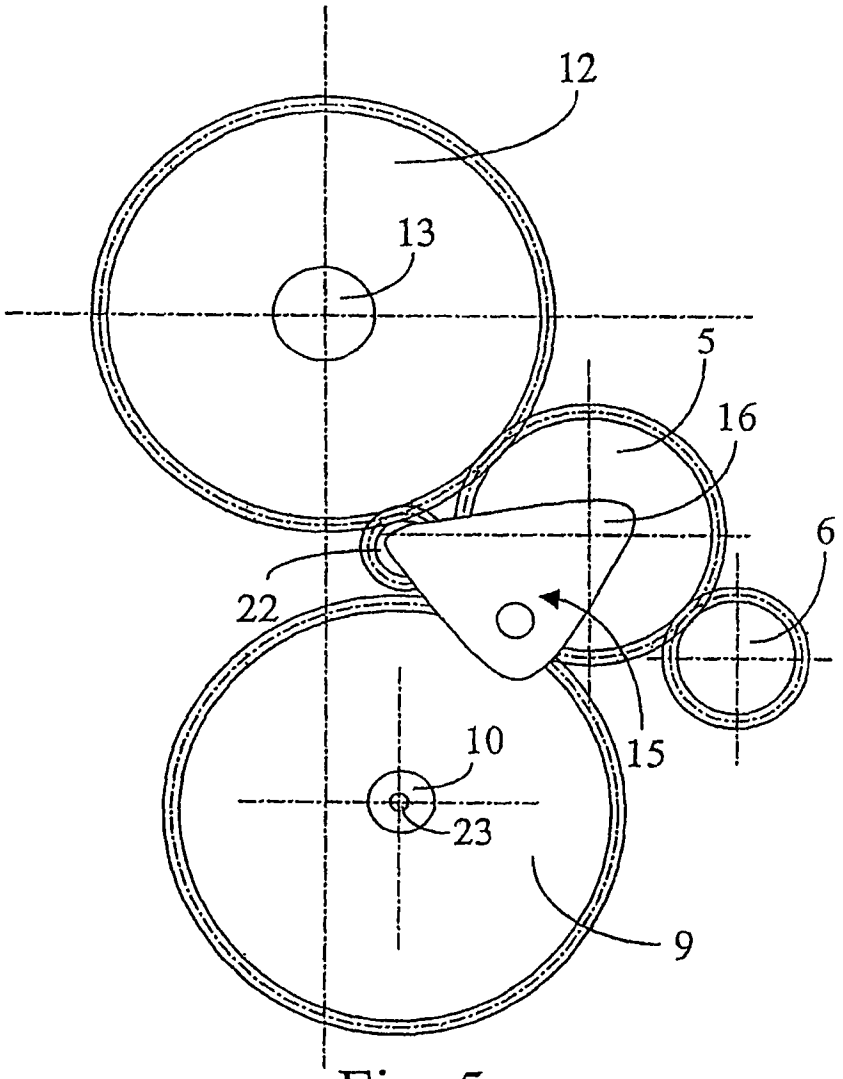
FIG. 5 shows an axial view of the embodiment according to FIG. 1.

In the illustrative embodiment shown in FIG. 6, the frame 16 of the device 15 does not have a complete gear wheel 22, but only a toothed segment 26 which is designed as part of a gear wheel. This toothed segment 26 engages with teeth of the drive wheel 12 by analogy with the gear wheel 22. In the simplest embodiment the device has only one gear wheel element which only forms one single tooth that can engage between two teeth of the drive wheel 12.

Figure 7:
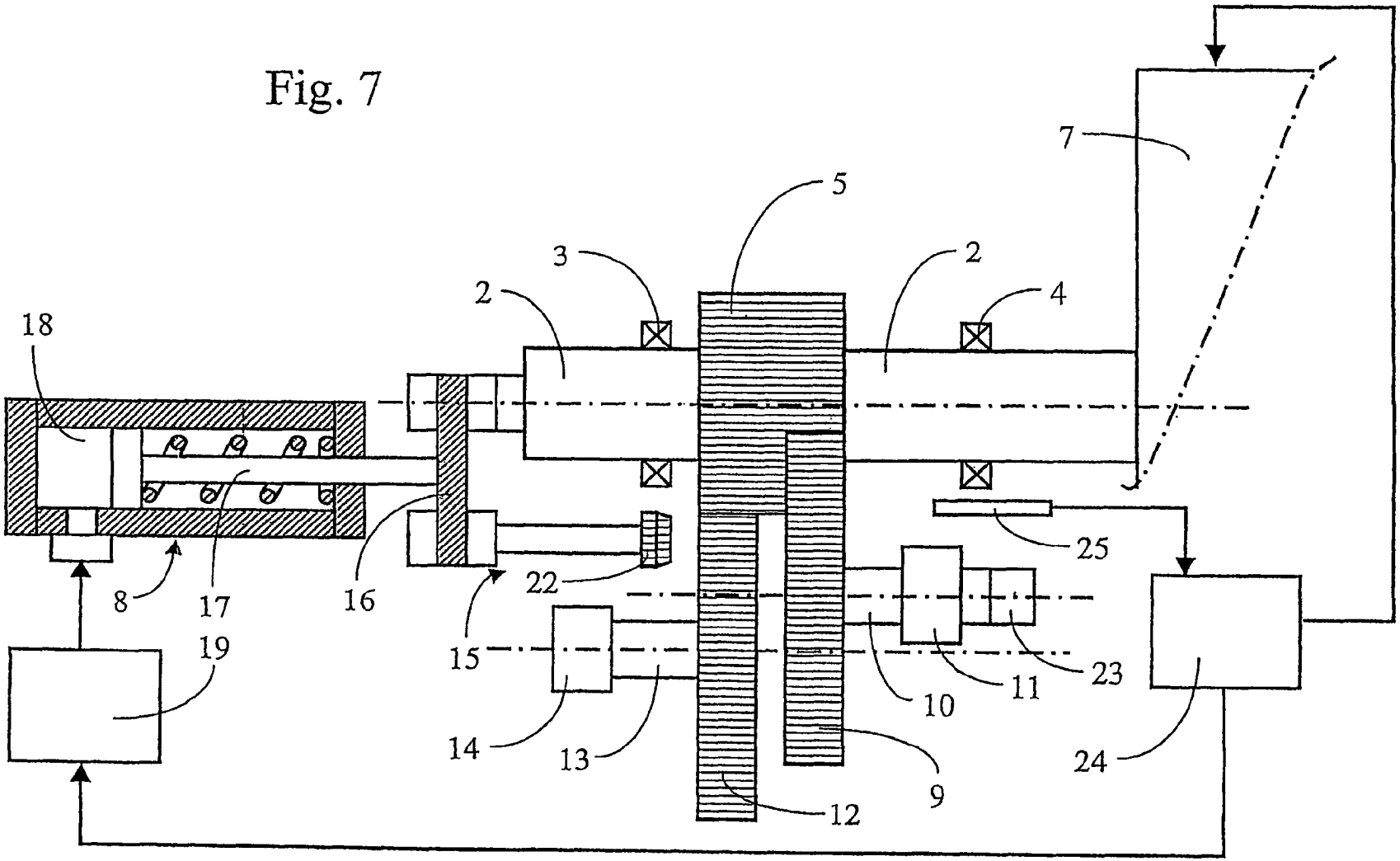
FIG. 7 shows a view similar to that of FIG. 3 with a switching wheel which is driven directly by a main drive motor.

In the illustrative embodiment shown in FIG. 7, the main drive shaft 2 comprising the switching wheel 5 and that is supported in the machine frame 1 by means of bearings 3 and 4 is the motor shaft of a drive motor 7. The main drive shaft 2 is designed and positioned by analogy with the description in EP 0 953 073 A1. The description in EP 0 953 073 A1 forms an integral part of the present patent application. In this illustrative embodiment, the switching wheel 5 is driven directly by the main drive motor 7.

Figure 8:
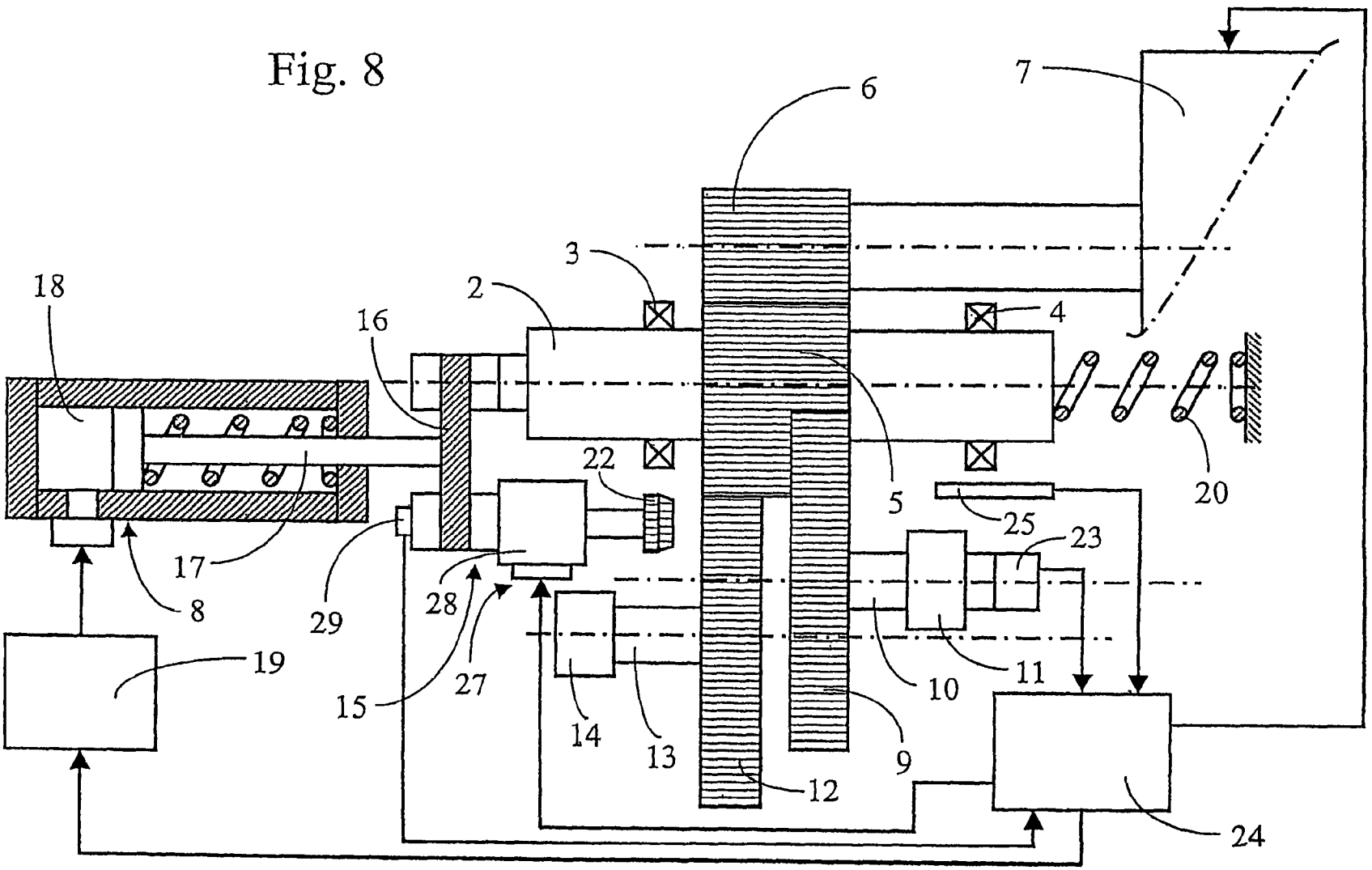
FIGS. 8-11 show views of further variant embodiments similar to that of FIG. 3.

In the illustrative embodiment shown in FIG. 8, the device 15 has a drive system 27 to drive the gear wheel 22. This drive system 27 has a drive motor 28 that is mounted on the frame 16 and can be controlled by means of the control unit 24. The drive motor 28 can, for example, consist of a hydraulic drive motor or a stepping motor. In this illustrative embodiment, it is possible to drive the drive wheel 12 and thus the associated group of elements to be driven 14 while these are disengaged from the switching wheel 5 and from the main drive shaft 2. Measures have to be taken here, of course, such as, for example, the provision of an extra angle transducer 29 for the determination of the angular position of the gear wheel 22, in order to compare, by means of the control unit 24, the angular position of the gear wheel 22 and the angular position of the drive wheel 9 determined by the angle transducer 23 and accordingly bring the drive motor 28 into a given angular position of the gear wheel 22 which is adapted to the angular position of the drive wheel 9 so that the switching wheel 5 again engages with the drive wheel 12 in a desired angular position, in order to re-engage the drive wheels 9 and 12 of the two groups of elements to be driven at a suitable angular position.

Figure 9:
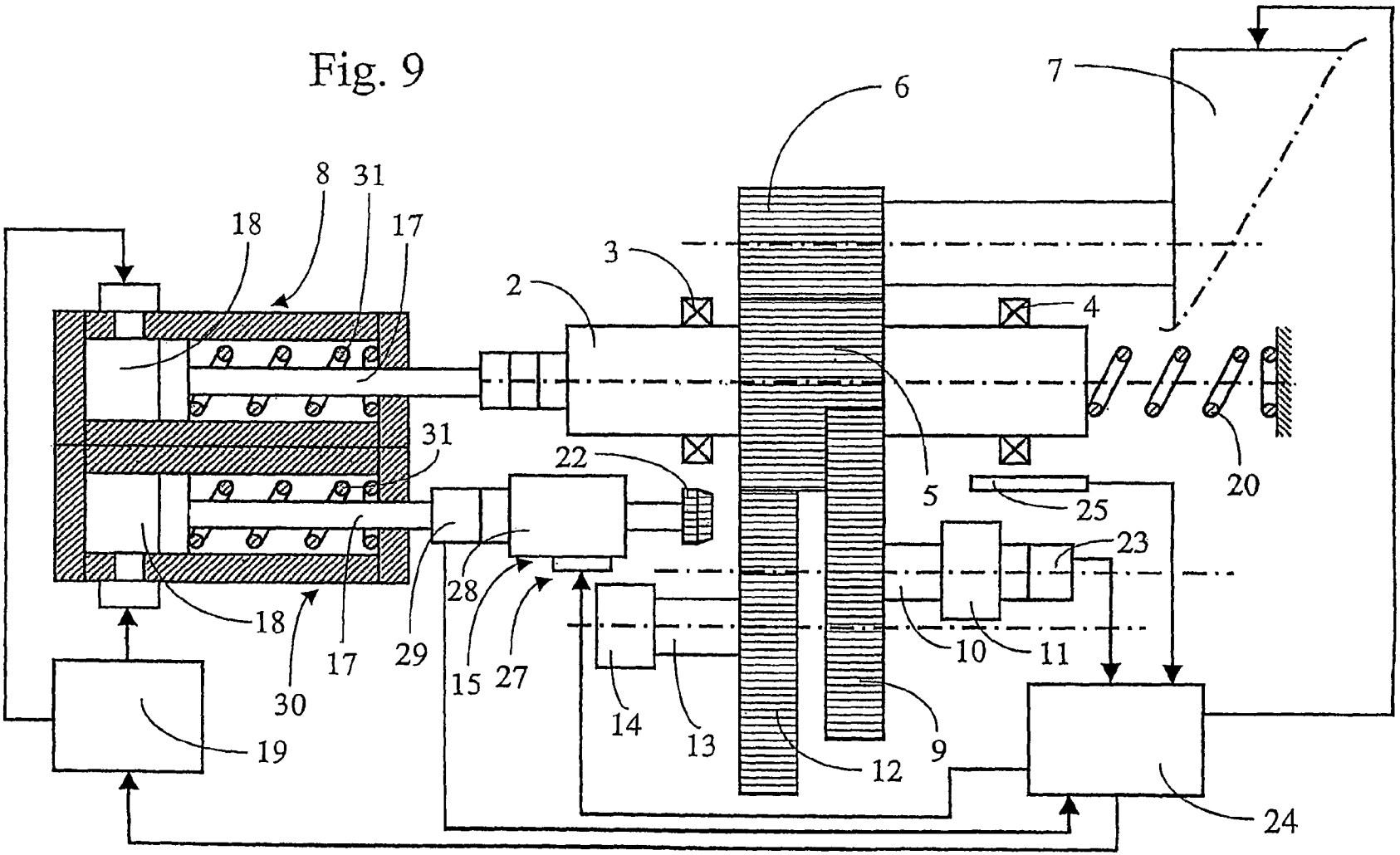

In the embodiment shown in FIG. 9, a separate shifting device 8 is provided for the shifting of the switching wheel 5 and a separate shifting device 30 for the shifting of the gear wheel 22. The two shifting devices 8, 30 are of essentially identical design and comprise a plunger 17, a cylinder 18 and a return spring 31. In the shifting device 30, the return is effected purely by means of the return spring 31. The shifting devices 8, 30 are preferably controlled in such a manner that the gear wheel 22 engages with the drive wheel 12 before the switching wheel 5 and the drive wheel 12 are completely disengaged. Analogously, the former are controlled in such a way that the gear wheel 22 is not disengaged from the drive wheel 12 until the switching wheel 5 and the drive wheel 12 have already been re-engaged. The gear wheel 22 thus does not only engage with the drive wheel 12 when the switching wheel 5 is in the second switching position, but already at the point in time when the switching wheel 5 is in the first switching position.

Figure 10:
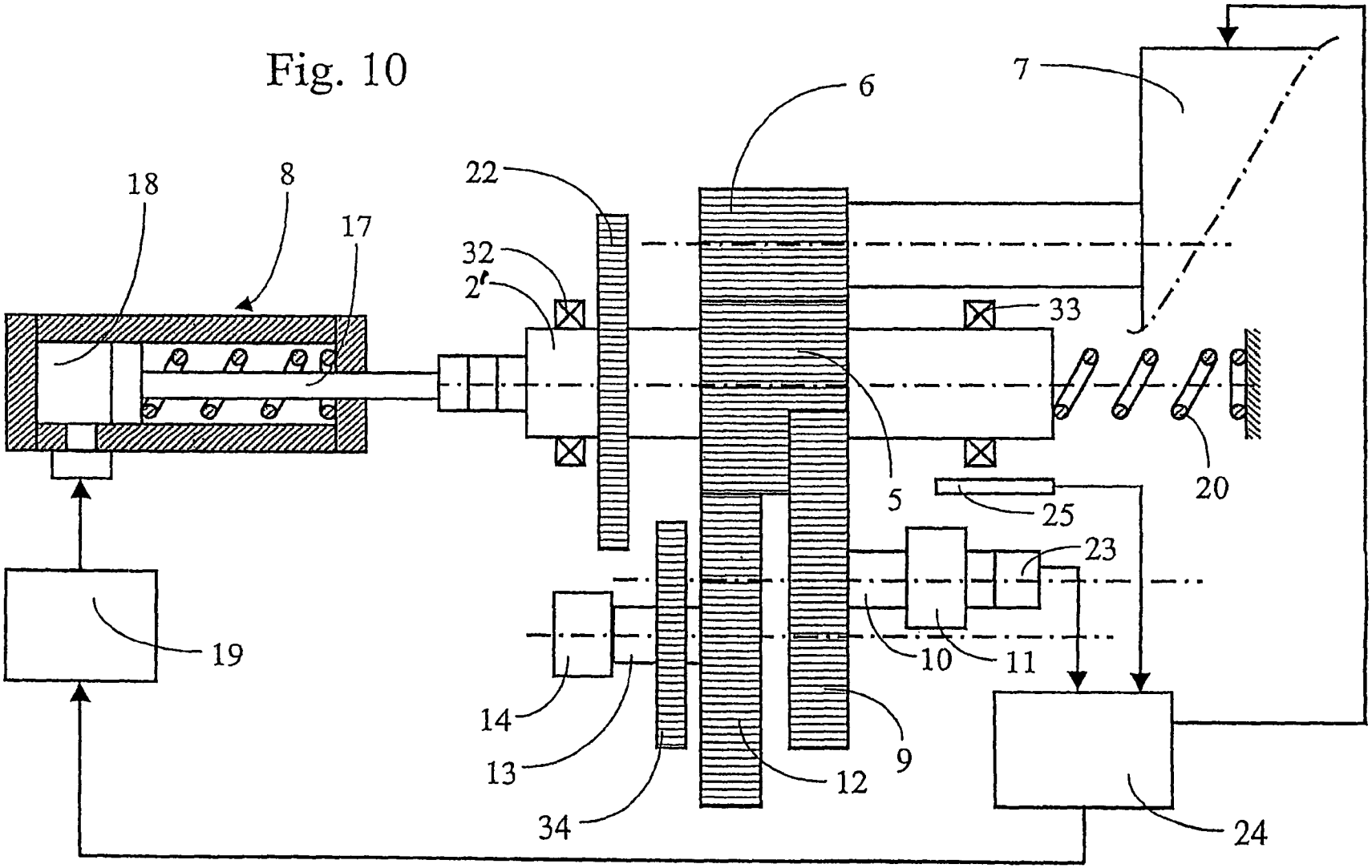

In the illustrative embodiment shown in FIG. 10, the switching wheel 5 is rotatably mounted on an axle 2' which is shiftably but not rotationally mounted in axial guides 32 and 33. The gear wheel 22 is arranged rotationally fixed on the axle 2' and is thus axially shiftable with this axle 2'. When the axle 2' is shifted in the axial direction by the shifting device 8 from the first switching position by analogy with FIG. 10 into a second switching position, the gear wheel 22 engages with a gear wheel 34 which is connected in a rotationally fixed manner to the shaft 13. Upon engagement of the gear wheel 34, the gear wheel 22 thus secures the rotation angle position of the shaft 13 and thus of the elements to be driven 14. In a variant embodiment, it is provided that the gear wheel 22 engages with a gear wheel which, unlike the gear wheel 34, is not arranged in a rotationally fixed manner on the shaft 13, but rather is connected in a rotationally fixed manner to the drive wheel 12 via a transmission stage.

Figure 11:
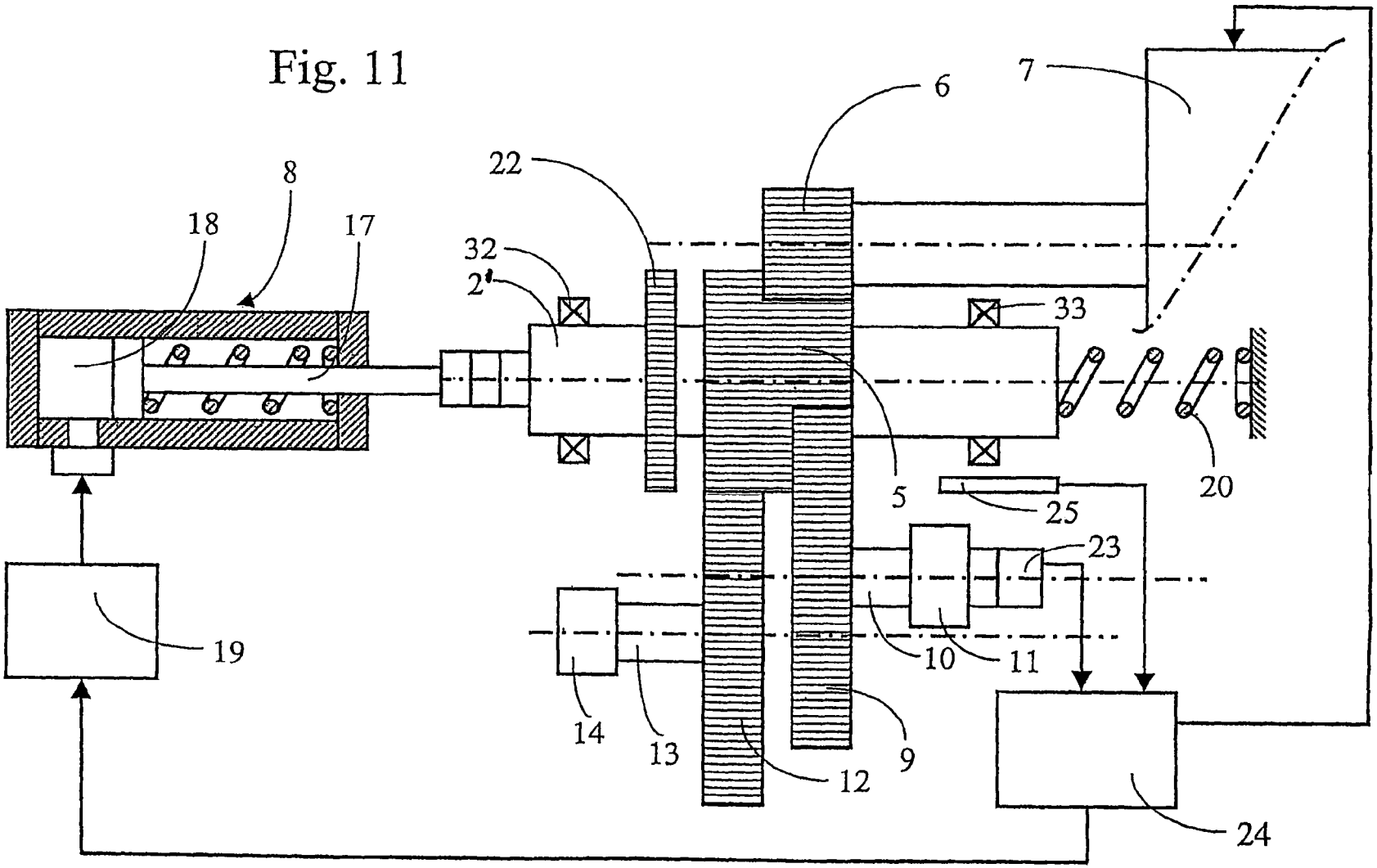

In the illustrative embodiment shown in FIG. 11, the shaft 2 or axle 2' is guided in an axially shiftable but rotationally fixed manner in axial guides 32, 33 by analogy with the illustrative embodiment shown in FIG. 10. The switching wheel 5 is rotationally supported on the axle 2' by means of bearings (not illustrated). A gear wheel 22 is also fixedly attached to the axle 2' at an axial distance from the switching wheel 5. When the axle 2' is shifted together with the switching wheel 5 and the gear wheel 22, the gear wheel 22 first engages with the drive wheel 12 and the switching wheel 5 is subsequently disengaged from the drive wheel 12 by further axial shifting. Analogously, upon disengagement, the switching wheel 5 already engages with the drive wheel 12 before a disengagement of gear wheel 22 and drive wheel 12 has taken place.

The invention is not limited to the illustrative embodiments shown and described. In particular, combinations of illustrative embodiments are possible.

The invention claimed is:

1. Drive system for a weaving loom comprising:

a switching wheel (5) arranged to be driven by a main drive motor (7) and which is axially displaceable between at least two switching positions, including a first switching position, which is in drive connection with first and second groups of elements to be driven (9, 10, 11; 12, 13, 14), and a second switching position, which is in drive connection with the first group of elements to be driven (9, 10, 11) and disengaged from the second group of elements to be driven (12, 13, 14); and a holding device (15) which becomes active as the drive connection of the switching wheel (5) with the second group of elements to be driven (12, 13, 14) is disengaged and which holds the second group of elements to be driven (12, 13, 14), which is disengaged from the switching wheel (5), in a defined position, said holding device (15) including a tooth element separate from the switching wheel (22, 26) which selectively engages in a large number of defined positions with teeth of a gear wheel (12, 34) of the second group of elements to be driven (12, 13, 14) when the second group of elements to be driven (12, 13, 14) is disengaged from the switching wheel (5), the large number of positions being determined by the number of teeth of the gear wheel (12, 34) of the second group of elements to be driven (12, 13, 14).

2. Drive system according to claim 1, wherein the tooth element (22, 26) of the holding device (15) is assigned to a drive wheel (12) which engages with the switching wheel (5) in the first switching position of the switching wheel (5).

3. Drive system according to claim 1, wherein the tooth element is a gear wheel (22) or a gear wheel segment (26).

4. Drive system according to claim 3, wherein the gear wheel (22) is connected to an auxiliary drive system (27) to which a control unit (24) is assigned by means of which the second group of elements to be driven (12, 13, 14) which is disengaged from the switching wheel (5) can be brought into a position adapted to the position of the first group of elements to be driven (9, 10, 11) before the drive connection with the switching wheel (5) is re-established.

5. Drive system according to claim 1, including an angle transducer (23) which directly or indirectly determines the rotation angle position of the switching wheel (5).

6. Drive system according to claim 1, wherein the tooth element (22, 26) is arranged to be shifted by means of a shifting device (8, 30).

7. Drive system according to claim 1, wherein the switching wheel (5) is arranged in a rotationally fixed manner on an axially shiftable shaft (2).

8. Drive system according to claim 1, wherein the switching wheel (5) is rotatably mounted on an axle (2') which axle (2') is mounted in a rotationally fixed and an axially shiftable manner and wherein the tooth element (22) is arranged on the axle (2'), and tooth element (22) engages with a gear wheel (12, 34) of the second group of elements to be driven (12, 13, 14), which second group of elements to be driven (12, 13, 14) is disengaged from the switching wheel (5), when the axle (2') is axially shifted.

9. Drive system according to claim 1, including a drive wheel (6) which is driven by the main drive motor (7) and which is assigned to the switching wheel (5), wherein said drive wheel (6) is engaged with the switching wheel (5) both in the first switching position and in the second switching position.

10. Drive system according to claim 1, wherein the switching wheel (5) is directly connected to the motor shaft of the main drive motor (7).

11. Drive system according to claim 6, wherein the shifting device (8, 30) also serves as a shifting device for the switching wheel (5).

12. Drive system according to claim 1, wherein the tooth element (22) is non-rotatable.

13. Drive system according to claim 1, wherein the tooth element (22) is a complete gear wheel.

14. Drive system according to claim 1, wherein the tooth element (22) is a segment (26) of a gear wheel.

15. Drive system for a weaving loom comprising:

a switching wheel (5) arranged to be driven by a main drive motor (7) and which is axially displaceable between at least two switching positions, including a first switching position, which is in drive connection with first and second drive wheels (9, 12), and a second switching position, which is in drive connection with the first drive wheel (9) and disengaged from the second drive wheel (12); and a holding device (15) which becomes active as the drive connection of the switching wheel (5) with the second drive wheel is disengaged and which holds the second drive wheel (12), which is disengaged from the switching wheel (5), in a defined position, said holding device (15) including a distinct tooth element separate from the switching wheel (22, 26) which selectively engages in a large number of defined positions with teeth of the second drive wheel (12) when the second drive wheel (12) is disengaged from the switching wheel (5), the large number of positions being determined by the number of teeth of the drive wheel (12).

16. Drive system according to claim 15, wherein the tooth element (22) is non-rotatable.

17. Drive system according to claim 15, wherein the tooth element (22) is a complete gear wheel.

18. Drive system according to claim 15, wherein the tooth element (22) is a segment (26) of a gear wheel.

* * * * *